US005295381A

United States Patent [19]

Nishikawa et al.

[11] Patent Number: 5,295,381

[45] Date of Patent: Mar. 22, 1994

[54] TWIST-FORMING PRESS FOR CRANK SHAFT OR THE LIKE

[75] Inventors: Junji Nishikawa; Hiromichi Konishi; Masashi Tado; Yasumasa Sato, all of Niihama, Japan

[73] Assignee: Sumitomo Heavy Industries, Ltd., Tokyo, Japan

[21] Appl. No.: 959,585

[22] Filed: Oct. 13, 1992

[51] Int. Cl.[5] ..... B21D 11/16; B21K 1/08

[52] U.S. Cl. ..... 72/299; 72/404; 72/453.02; 29/6.01

[58] Field of Search ..... 72/299, 298, 404, 405, 72/472, 453.02, 453.01, 448; 29/6.01; 100/257

[56] References Cited

U.S. PATENT DOCUMENTS

| | | | |
|---|---|---|---|
| 1,553,638 | 9/1925 | Shaw | 72/298 |
| 3,429,156 | 2/1969 | Eriksson | 72/456 |
| 3,889,515 | 6/1975 | Grombka | 100/257 |
| 4,079,617 | 3/1978 | Whiting | 72/453.02 |
| 4,137,840 | 2/1979 | Kubota | 100/257 |

FOREIGN PATENT DOCUMENTS

| | | | |
|---|---|---|---|
| 947943 | 8/1956 | Fed. Rep. of Germany . | |
| 215711 | 11/1984 | Fed. Rep. of Germany | 29/6.01 |
| 243241 | 10/1991 | Japan | 72/299 |
| 573832 | 9/1977 | U.S.S.R. | 72/299 |
| 612393 | 11/1948 | United Kingdom | 72/448 |
| 618920 | 3/1949 | United Kingdom . | |
| 2145018 | 3/1985 | United Kingdom . | |

*Primary Examiner*—Daniel C. Crane

*Attorney, Agent, or Firm*—Nikaido Marmelstein Murray & Oram

[57] ABSTRACT

A twist-forming process and a coining process for a crank shaft are carried out by using one twist-forming press including a twist forming section and a coining section, and a stopper height adjusting means for determining the crank pin arrangement and for finely adjusting the twist angles is integrally incorporated into the twist-forming press.

11 Claims, 9 Drawing Sheets

TWIST-FORMING PRESS FOR CRANK SHAFT OR THE LIKE

BACKGROUND OF THE INVENTION

The present invention relates to a twist-forming press for twisting a half-finished forged crank shaft or the like by applying a downward Pressing force on a portion of the shaft.

Heretofore, when a half-finished forged crank shaft or the like is to be twist-formed, there are provided a special-purpose twist-forming press (twister) and a special-purpose coining press. The shaft is first subjected to a twisting process, and then, to a coining (correcting) process.

When a half-finished, crank shaft having a plurality of crank pins is to be twist-formed, the twist angle is required to be so determined that the crank pins are arranged around the center of the crank shaft at predetermined angular intervals. When a crank shaft having a different crank pin arrangement is to be formed by using the same twist-forming press (twister), the twist angle of the twister is required to be changed according to the pin arrangement, for example, among angles of 30°, 45°, 60° and so on. Further, a fine adjustment of the twist angle is required due to the abration of dies of retainers used for twisting. In the past, the above-mentioned change of the twist angle was carried out by manually exchanging a stopper provided to determine the rotary angle of the retainer, and the above-mentioned fine adjustment of the twist angle was carried out by inserting shims between a twist plate and a roller mounted on the retainer.

As mentioned above, a twist-forming of a crank shaft requires two presses separated from each other, and as a result. There are required a special-purpose work convey means between these two presses and a work attitude correcting means including various detectors at the work inlet area for the coining press. As a consequence, the apparatus for twist-forming becomes complex and of a large size, and includes problems with respect to its operability, maintainability, installation space and installation cost. In addition, there is a disadvantage that the automation of the production process, in which a transfer feeder is used for improving the productivity, and the quality control of the product both become difficult. Further, as mentioned above, in twist-forming of pin portions of a crank shaft, the twist angle of the twister is required to be changed according to the pin arrangement, for example, among angles of 30°, 45°, 60° and so on, and a fine adjustment of the stroke of the twist plate is required due to the abration of dies or retainers used for twisting. In the past, these change and fine adjustments were carried out by manually exchanging a stopper provided on a lower bolster (merely replacing with a stopper having a different height) and by manually adjusting shims on the stopper and shims between the twist plate and the roller on the retainer. As a result, there are several inconveniences that the operability is deteriorated, adjustment requires a long time, and the actually adjusted amounts can not be simply confirmed from the outside.

SUMMARY OF THE INVENTION

An object of the present invention is to provide a twist-forming press for twisting a crank shaft in which the twist-forming and the coining are both carried out by using one press.

Another object of the present invention is to provide a twist-forming press for twisting a crank shaft in which the change of the twist angle corresponding to the number of the crank pins and the fine adjustment of the stopper position for compensating the abrasion of dies or retainers are carried out by a stopper height control mechanism, but not by manually controlled shim means, and the adjusted twist angle can be automatically detected.

For achieving the above-mentioned objects, a twist-forming press for twisting a crank shaft according to the present invention is characterized in that, as shown in the attached drawings, the press comprises two main cylinders 7 and 8, a slide 10 connected with ram tips of these cylinders 7 and 8, a bed 2, twist-forming dies 17*a* and 17*b* disposed between the slide 10 and the bed 2 with the center of the dies located on the axial center line of the cylinder 7, and coining dies 25*a* and 25*b* disposed between the slide 10 and the bed 2 with the center of the dies located on the axial center line of the cylinder 8. Further, a twist-forming press according to the present invention, in which a workpiece is put between the upper twist-forming die and the lower twist-forming die and twisted by rotating the paired upper and lower retainers about a common axis, comprises a movable stopper on the lower bolster for controlling the angle of the retainer rotation and a stopper height adjusting means for adjusting the height of the movable stopper. In addition, the stopper height adjusting means includes a wedge member extending on the lower side the movable stopper from the front to the rear of the twist forming die and wedgingly engaging with the movable stopper, a screwed transfer means disposed at the front side of the twist-forming die for moving the wedge member forwards and backwards, and a spring means urging the movable stopper against the wedge member.

DESCRIPTION OF THE PREFERRED EMBODIMENTS

Figure 1:
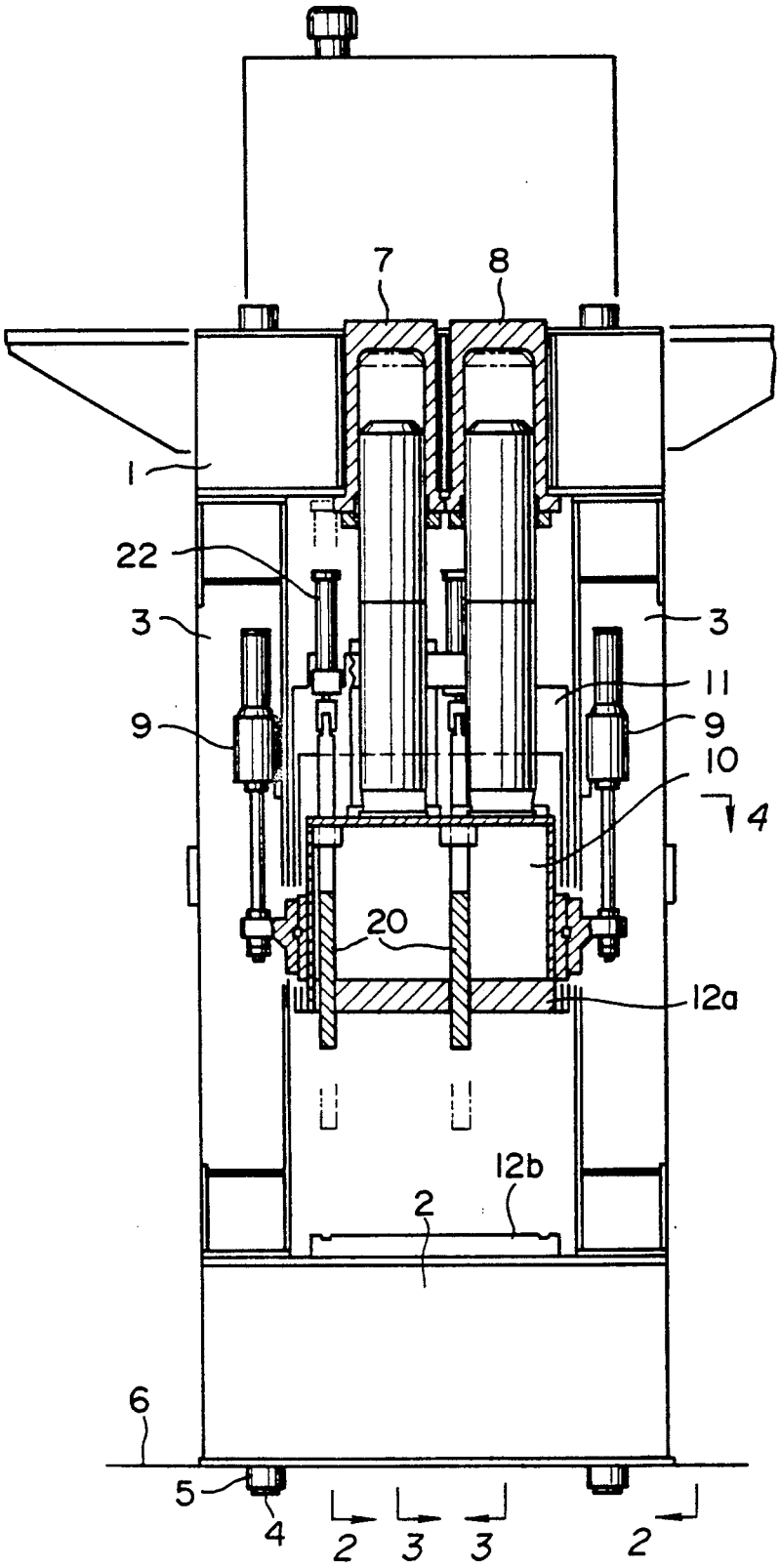
FIG. 1 is a front sectional view of a twist-forming press according to an embodiment of the present invention taken on line 1A—1A of FIG. 2.
Figure 2:
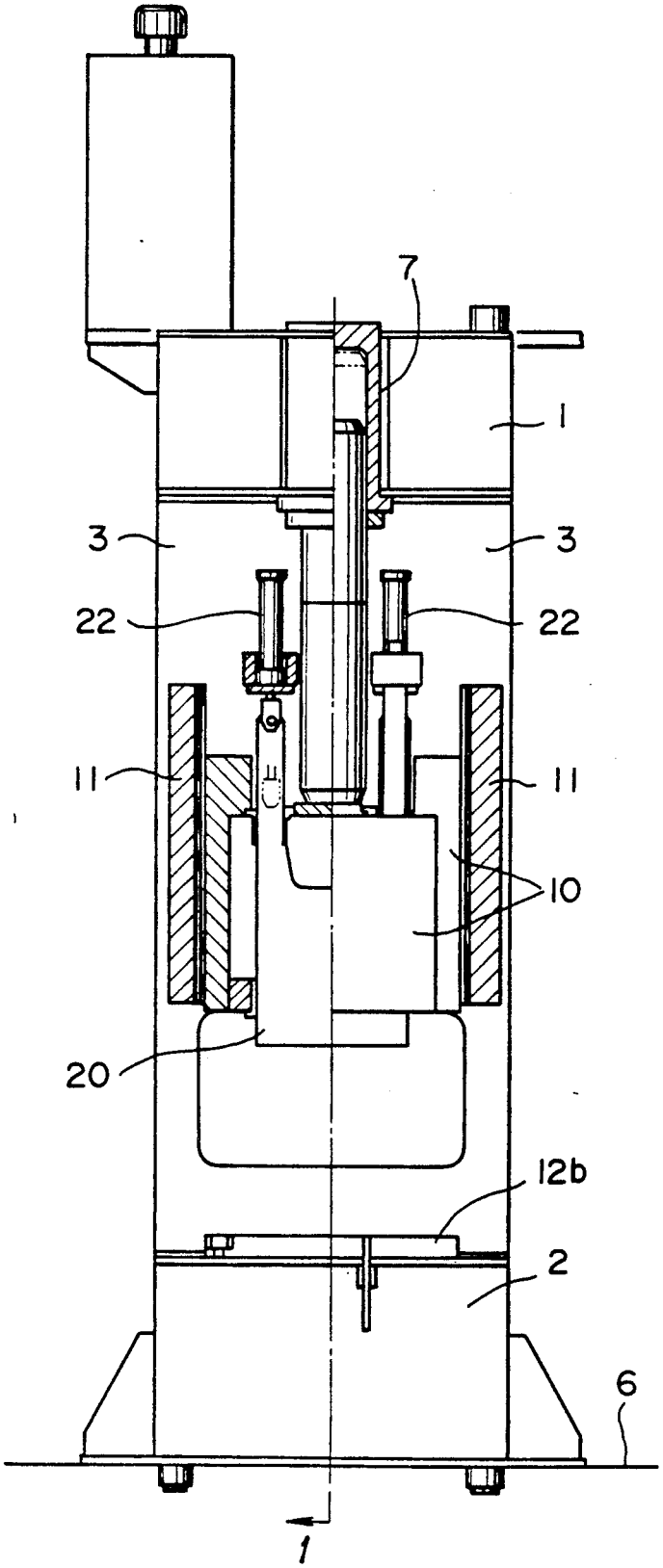
FIG. 2 is a left side sectional view the, left half of which is a sectional view taken on line 2B—2B of FIG. 1 while the right half is a sectional view taken on line 3C—3C of FIG. 1.
Figure 3:
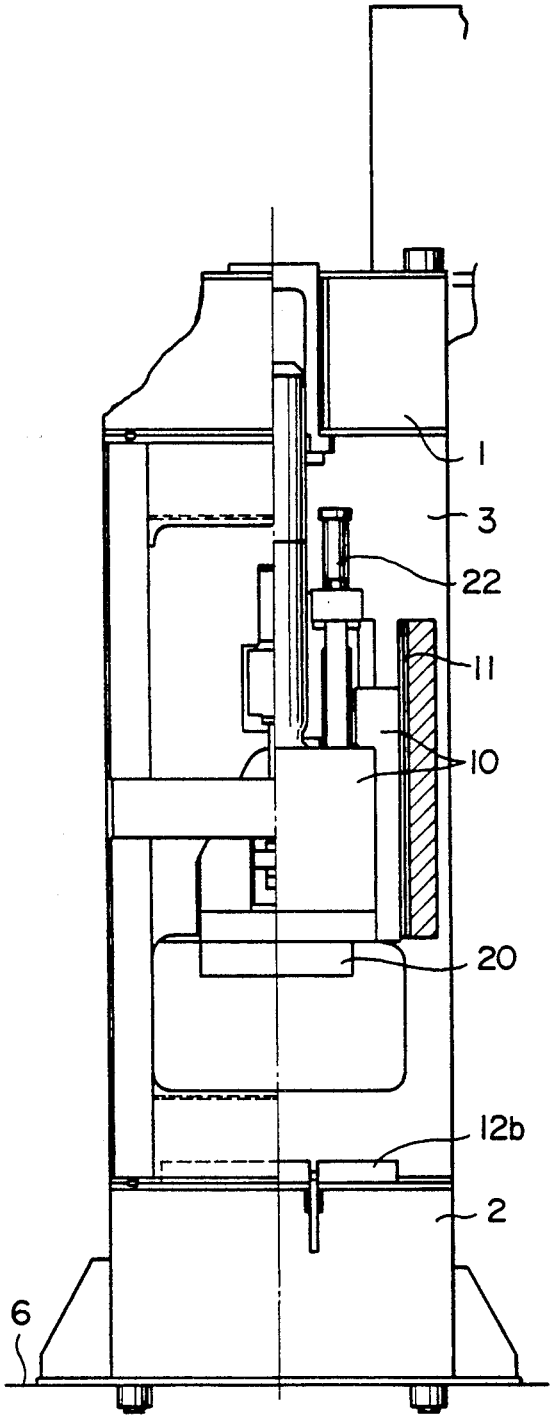
FIG. 3 is a right side sectional view, the left half of which is a sectional view taken on line 3D—3D of FIG. 1 while right half is a sectional view taken on line 2B—2B of FIG. 1.
Figure 4:
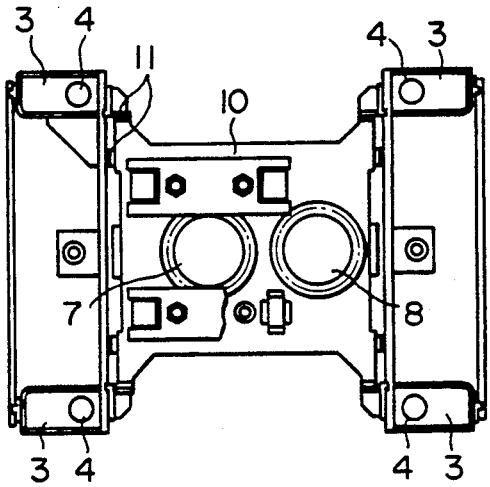
FIG. 4 is a plan sectional view taken on line 4A—4A of FIG. 1.

Referring to the attached drawings, an embodiment of the present invention will be described below in detail.

Referring to FIGS. 1 to 6, the frame of a twist-forming press according to the present invention is composed of a crown 1, a bed 2 and columns 3. The crown 1 and the bed 2 are located at an upper position and a lower position opposed to each other with the four columns interposed therebetween, and are connected with each other by means of tie rods extending through the inside of the columns with nuts engaging with the tie rods. The frame of the press is installed with the bed 2 fixed to a base 6 for the machine.

In the crown 1 are arranged two main cylinders 7 and 8 in the work conveying direction (left to right in FIG. 1) with a distance therebetween substantially equal to that between two groups of dies (described later). Each of the columns is mounted with a lifting cylinder 9. The slide 10 is guided in a vertical direction by guides 11 fixed to the columns 3, and connected with the ram tip portions of the main cylinders 7 and 8 and with the tips of the pistons of the cylinders 9, thereby making it possible for the slide 10 to move upward or downward along the column 3.

On the lower surface of the slide 10 is attached an upper bolster 12*a*, and on the upper surface of the bed 2 is attached a lower bolster 12*b*.

A twist-forming section 13 is arranged on a work inlet side between the slide 10 and the bed 2 with its twist center P located on the axial center line of the main cylinder 7. On the work inlet side of the upper bolster 12*a* are provided an upper retainer support member 14*a*, an upper die support member 15*a*, and an upper retainer 16*a*. On the work inlet side of the lower bolster 12*b* are provided a lower retainer support member 14*b*, a lower die support member 15*b* and a lower retainer 16*b*, these upper members and lower members being opposed to each other in vertical direction. The upper die support members $15a_1$, and $15a_2$ are fixed to the upper bolster 12*a*, and the upper retainer support members $14a_1$, $14a_2$ and $14a_3$ are attached to the side surfaces of the upper die support members $15a_1$ and $15a_2$ or directly to the upper bolster 12*a*. The upper retainer support members $14a_1$, $14a_2$ and $14a_3$ rotatably support the upper retainers $16a_1$, $16a_2$ and $16a_3$, respectively.

On the other hand, on the lower bolster 12*b* are alternately arranged lower retainer support members $14b_1$, $14b_2$ and $14b_3$, and lower die support members $15b_1$ and $15b_2$ as directed perpendicular to the work moving direction. The lower retainer support members $14b_1$, $14b_2$ and $14b_3$ rotatably support the lower retainers $16a_1$, $16a_2$ and $16a_3$.

Further, to the upper retainers 16*a* are attached upper twist-forming dies 17*a*, and to the lower retainers 16*b* are attached lower twist-forming dies 17*b*. Each of the upper retainer 16*a* is formed with an arm 18 projecting alternately slantly upwards from one side thereof, at the tip of which is provided a roller 19. The roller 19 is interposed between a plate-like twist ram 20 extending perpendicularly to the work moving direction and a twist return beam 21 disposed below the twist ram 20. Further, the twist ram 20 penetrates the upper bolster 12*a* and is connected with a twist-forming cylinder 22. The upper and lower twist-forming dies 17*a* and 17*b* are so arranged that the rotation center (twist center P) defined by the upper retainer support member 14*a* and the lower retainer support member 14*b* is positioned on the axial center line of the main cylinder 7.

A coining section 23 is arranged on the work outlet side adjacent to the twist-forming section 13 with the coining center Q located on the axial center line of the main cylinder 8. In detail, to the work outlet side of the upper bolster 12*a* is attached an upper coining die support member 24*a* and to the work outlet side of the lower bolster 12*b* is attached a lower coining die support member 24*b*. The upper coining die 25*a* is fixed to the upper bolster 12*a* by means of the upper coining die support member 24*a*, and the lower coining die 25*b* is fixed to the lower bolster 12*b* by means of the lower coining die support member 24*b*. The upper and lower coining dies 25*a* and 25*b* are so arranged as to locate its center (coining center Q) on the axial center line of the main cylinder 8.

Next, referring to FIGS. 7 to 11, the stopper height adjusting means will be described below.

On the bed 2 of the twist-forming section 13 is disposed the lower bolster 12*b* with a bed hard plate 2*a* interposed therebetween. Movable stoppers 26 are arranged at the four corners of the twist-forming section 13. In this embodiment, each of the movable stoppers 26 is composed of an abutment portion 26*a* and a lower slide portion 26*b* fixedly mounting the abutment portion 26*a*. As clearly shown in FIG. 7, the slide Portion 26*b* has a lower portion having a U-shaped crosssection, and the bottom of the U-shape is formed with a tapered surface. Among the four movable stoppers 26, paired movable stoppers arranged-before and behind have tapered surfaces having the same taper direction, and on the under side of the slide portion 26*b* of each of the paired movable stoppers 26 is arranged a wedge member 27 extending in the fore and aft direction and being movable in the same direction.

Figure 8:
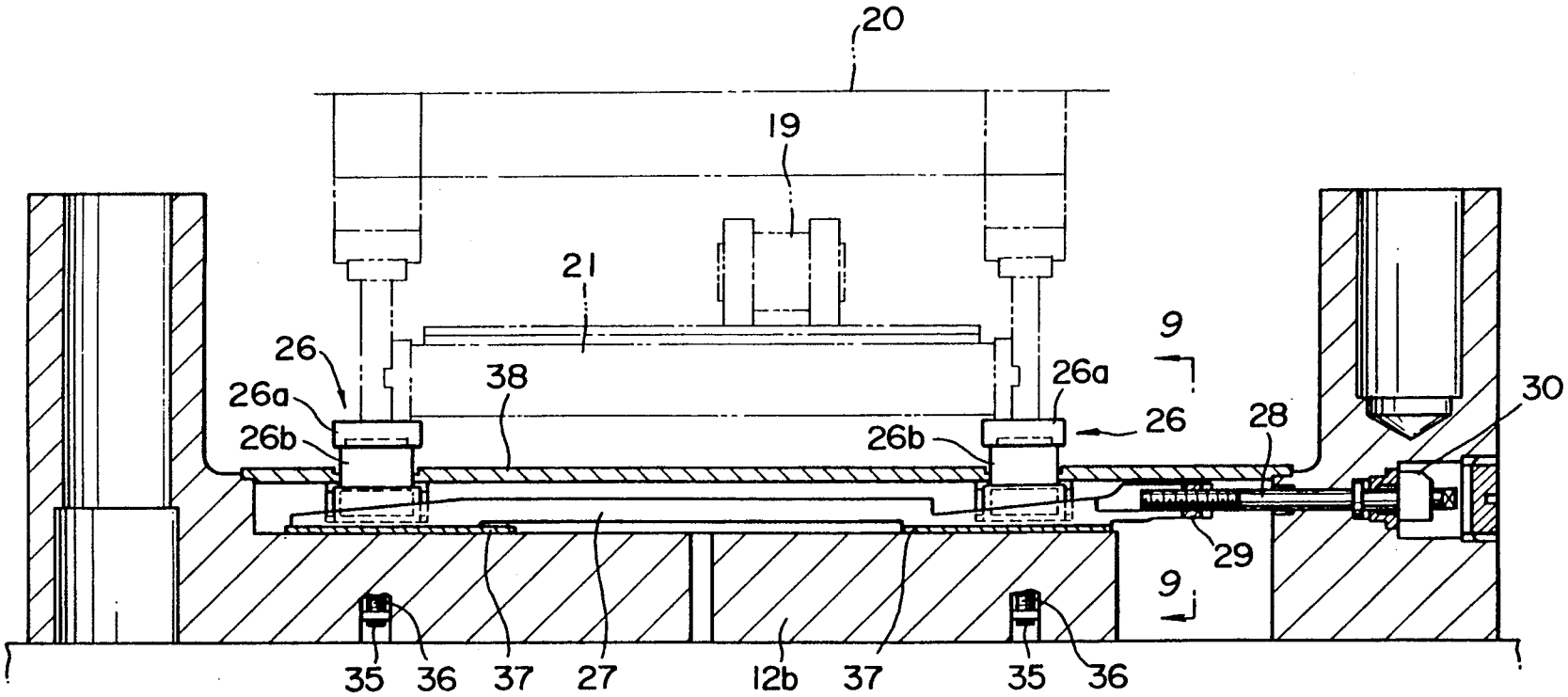
FIG. 8 is a side sectional view taken on line 8G—8G of FIG. 7.
Figure 9:
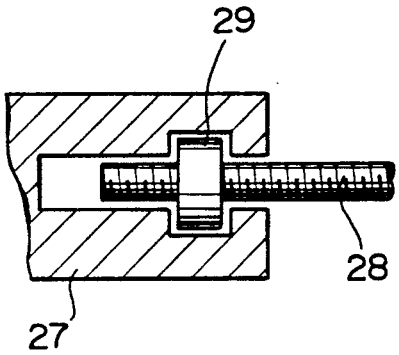
FIG. 9 is an enlarged sectional view taken on line 9H—9H of FIG. 8.

As shown in FIG. 8, the upper surface of the wedge member 27 has wedge-shaped portions at regions opposite to the movable stoppers 26, and the U-shaped bottom of slide portion 26*b* wedgingly engages with the wedge member 27, with the legs of the U-shape bottom straddling the wedge member 27. Into the front portion of the lower bolster 12*b* is inserted a feeding screw shaft 28 toward the wedge member 27. The tip portion of the feeding screw shaft 28 is screwed into a nut 29 held by the front portion of the wedge member 27. The tip portion of the feeding screw shaft 28 is not enclosed by the lower bolster 12*b*, but exposed to the outside, and at this position is arranged an indicator 30.

Figure 10:
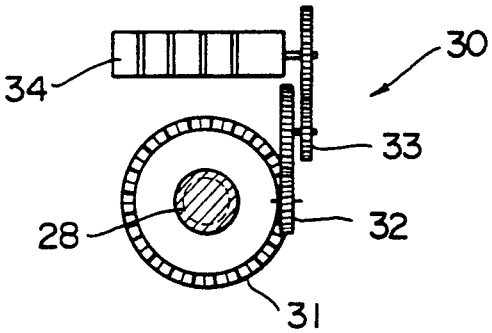
FIG. 10 is an illustration of the mechanism of the indicator portion.
Figure 11:
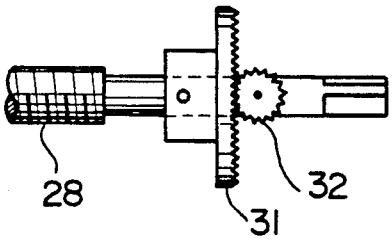
FIG. 11 is a side view of the end portion of the screwed transfer shaft locating on the indicator mounting side.

As shown in FIGS. 10 and 11, the indicator 30 is composed of a front gear 31 mounted on the feeding screw shaft 28, transmission gears 32 and 33, and a digital counter 34 connected to the feeding screw shaft 28 through these gears. A bolt 35 penetrates the lower bolster 12*b* and is screwed to the slide portion 26*b* of the movable stopper 26. A compression spring 36 is disposed between the head of the bolt 35 and the under surface of the lower bolster 12*b*. By virtue of the compression spring 36, the movable stopper 26 is always urged downwards to engage with the wedge member 27. For making the wedge member 27 smoothly move, a liner 37 is adhered between the wedge member 27 and the lower bolster 12*b*.

Figure 7:
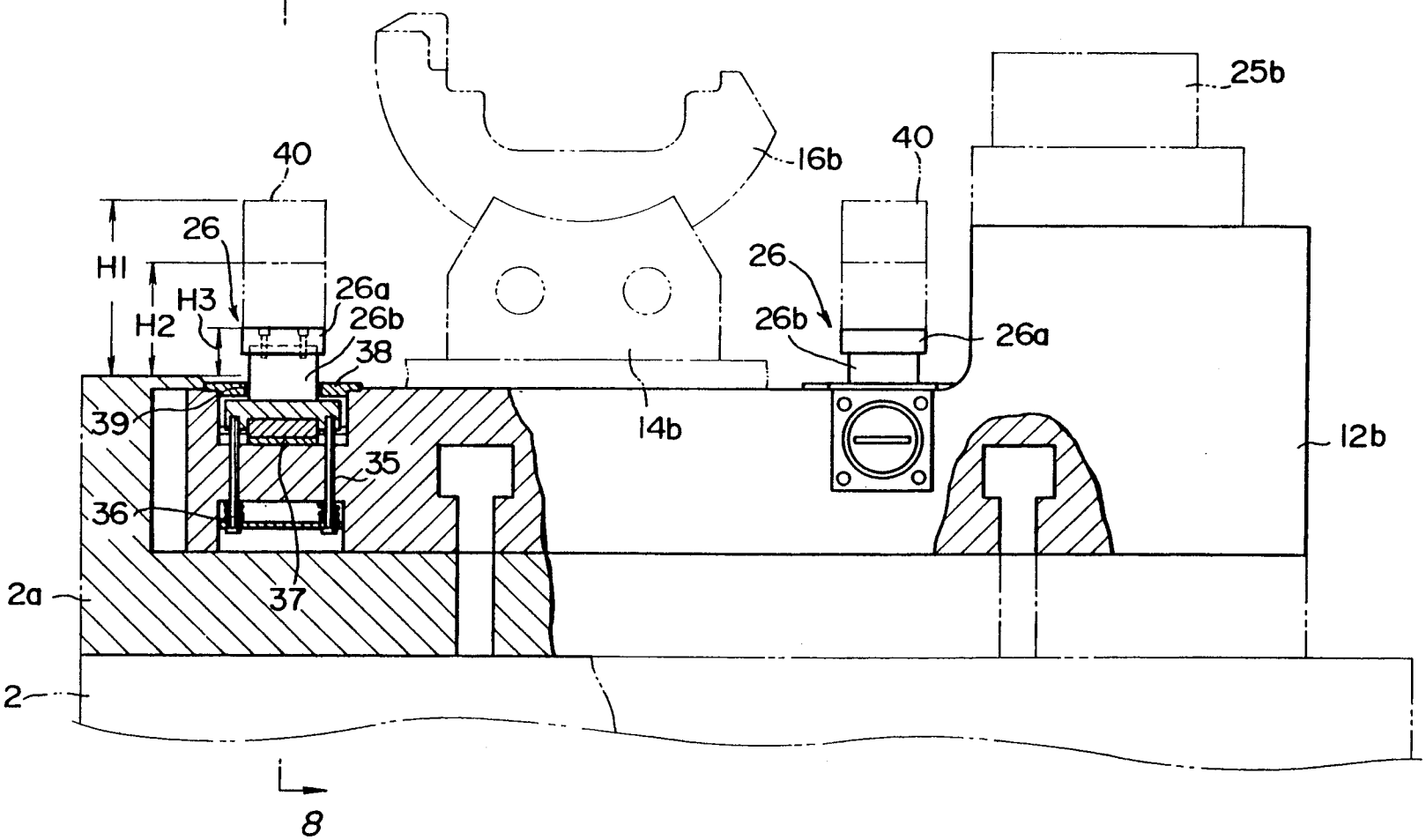
FIG. 7 is a partially sectional front view of the stopper height adjusting means.

In order to protect the wedgingly engaging surface between the wedge member 27 and the movable stopper 26 from scales produced in a twist-forming process, there is provided a cover 38 and a dust seal 39 on the upper surface of the lower bolster 12*b*. Further, as shown in FIG. 7, on the upper surface of the movable stopper 26 is mounted a fixing stopper 40, the height of which can be changed according to the twist angle of a crank shaft, for example, angles of 30°, 45° or 60°.

Figure 12:
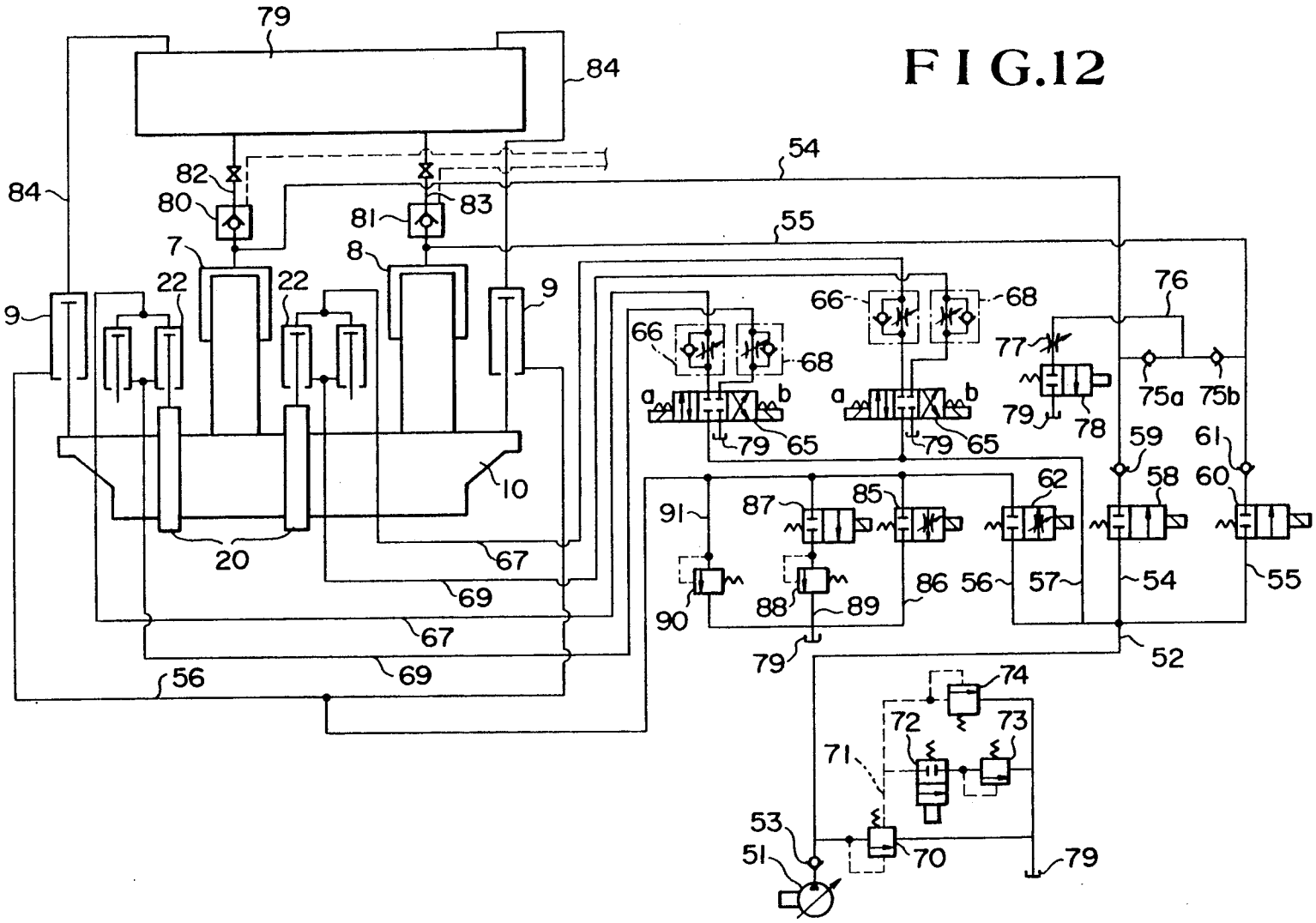
FIG. 12 is a control circuit diagram for the cylinders.

Next, referring to FIG. 12, a control circuit for a twist-forming process for a crank shaft or the like according to the present invention is shown.

In an outlet tube passage 52 of a variable delivery hydraulic pump 51 is arranged a check valve 53, and the outlet tube Passage 52 is branched into four tube passages 54 to 57 at a point downstream of the check valve 53.

Among the branched four tube passages, the first tube passage 54 is connected through an electromagnetic switch valve 58 of the two port, two position type and a check valve 59 with the before-mentioned main cylinder 7. The second tube passage 55 is connected through an electromagnetic switch valve 60 of the two port, two position type and a check valve 61 with the before-mentioned main cylinder 8. The third tube passage 56 is connected through a throttleable electromagnetic switch valve 62 of the two port, two position type with the rod side room of the before-mentioned lifting cylinder 9. The fourth tube 57 is provided with an electromagnetic switch valve 65 of the four port, three position type, and the outlet ports of the switch valve 65 on one side thereof are connected through a throttleable check valve 66 and a tube passage 67 with the anti-rod side room of the before-mentioned twist-forming cylinder 22. The outlet ports of the switch valve 65 on the other side thereof are connected through a throttleable check valve 68 and a tube passage 69 with the rod side room of the twist-forming cylinder 22.

Further, it is also possible that the fourth tube passage 57 is branched into two tube passages at a point upstream of the above-mentioned electromagnetic switch valve 65. Each of the branched tube passages is provided with an electromagnetic switch valve 65 of the four port, three position type, and throttleable check valves 66 and 68, whereby pressurized oil is supplied to or discharged from a plurality of twist-forming cylinders 22 in parallel under control of the throttleable check valves 66 and 68.

The outlet tube passage 52 of the hydraulic pump 51 is connected at a point downstream of the check valve 53 with a relief valve 70 of the outside pilot type. The outside pilot tube 71 is provided with an electromagnetic switch valve 72 of the two port, two position type, a low pressure relief valve 73 in series, and a high pressure relief valve 74 is parallel. Thus, by selectively switching the electromagnetic switch valve 72, the relief pressure of the outside pilot relief valve 70 can be switched between a high pressure state and a low pressure state.

The first tube passage 54 and the second tube passage 55 are connected with each other at points downstream of the check valves 59 and 61 through check valves 75*a* and 75*b*, which permits an oil flow from the tube passages 54 and 55, respectively. A tube passage 76 branched from between the check valves 75*a* and 75*b* is extended through a throttleable valve 77 and an electromagnetic switch valve 78 of the two port, two position type and released to a tank 79. The main cylinders 7 and 8 are connected with the tank 79 through pilot check valves 80 and 81 and tube passages 82 and 83, respectively. The pilot ports of the pilot check valves 80 and 81 are connected with a pilot pressure source (not shown), and the anti-rod side room of the before-mentioned lifting cylinder 9 is connected with the tank 79 through a tube passage 84.

The third tube passage 56 is branched at a point downstream of a throttleable electromagnetic switch valve 62 of the two ports, two position type into three tube passages arranged in parallel, namely, a tube passage 86 provided with a throttleable electromagnetic switch valve 85 of the port, two position type, a tube passage 89 provided with an electromagnetic switch valve 87 of the two port, two position type and a relief valve 88 arranged in series, and a tube passage 91 provided with a safety relief valve 90, these three tube passages 86, 89 and 91 being released to tank 79.

Next, the operational sequence for the twist-forming press according to the present invention will be described below.

Firstly, a fixing stopper 40 is selected according to the desired twist angle of a workpiece W, and disposed on the movable stopper 26 as shown in FIGS. 7 and 8. There may be, of course, a case of requiring no fixing stopper.

Next, the movable stopper 26 is moved upward or downward to a height corresponding to the rotation angle of the retainer, namely the twist angle of the crank shaft. In detail, the height of the movable stopper 26 is continuously adjusted by means of the before-mentioned height adjusting means of the wedge type which can be operated from the front side of the twist-forming section 13. The adjusted amount of the movable stopper is indicated on an indicator mounted on the feeding screw shaft based on the screw pitch of the feeding screw shaft for feeding the wedge member and the inclination of the surface of the wedge member. As a result, the adjusted amount is continuously confirmed, and a fine adjustment is made possible.

a) Slide Lowering Operation

Referring to FIG. 12, by opening the throttleable electromagnetic switch valve 85 of the two port, two position type connected to the third tube passage 56 by exciting the switch valve 85, the oil existing in the rod side room of the lifting cylinder 9 flows out downwards into the tank 79 due to the gravity of the slide 10 as being throttled by the switch valve 85. At the same time, the anti-rod side room of the lifting cylinder 9 is depressurized and supplied with oil through the tube passage 84. As a result, the slide 10 is lowered at a speed corresponding to the throttle degree of the switch valve 85.

b) Die Clamping, and Coining Operations

When the slide 10 is lowered to a predetermined position, the switch valve 85 is deenergized and closed, while the switch valve 87 is excited and opened, and the switch valves 58 and 60 connected to the tube passages 54 and 55, respectively, are also excited and opened.

During this process, the pilot relief valve 80 and 81 are not applied by pilot pressures, and as a result, the pressurized oil from the hydraulic pump 51 is supplied to the main cylinders 7 and 8. At the same time, the oil in the cylinder 9 flows out into the tank 79, thereby further lowering the slide 10.

Figure 5:
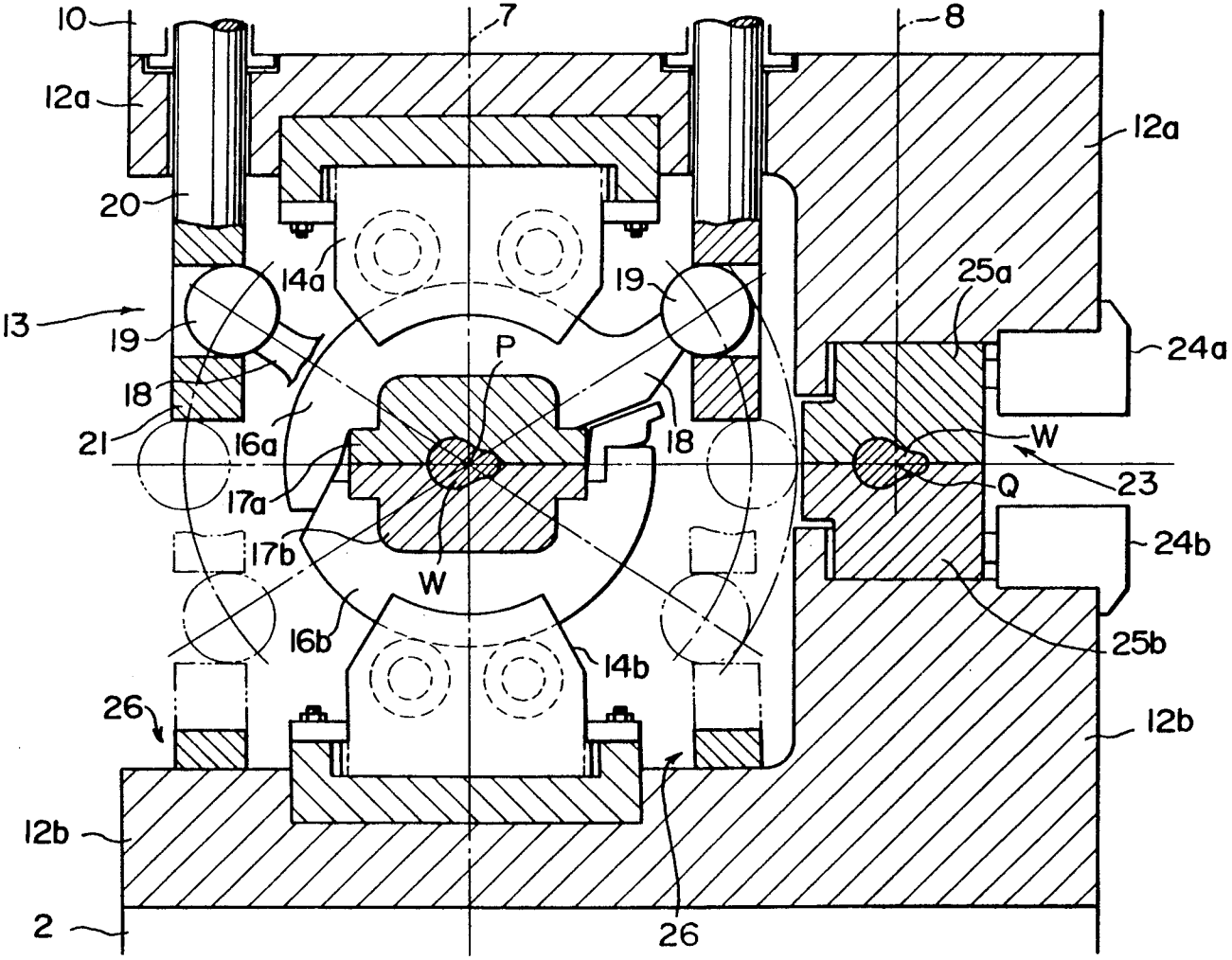
FIG. 5 is an enlarged front view of the main portion of the press illustrating a condition in which a twist-forming process and a coining press are being carried out at the same time.
Figure 6:
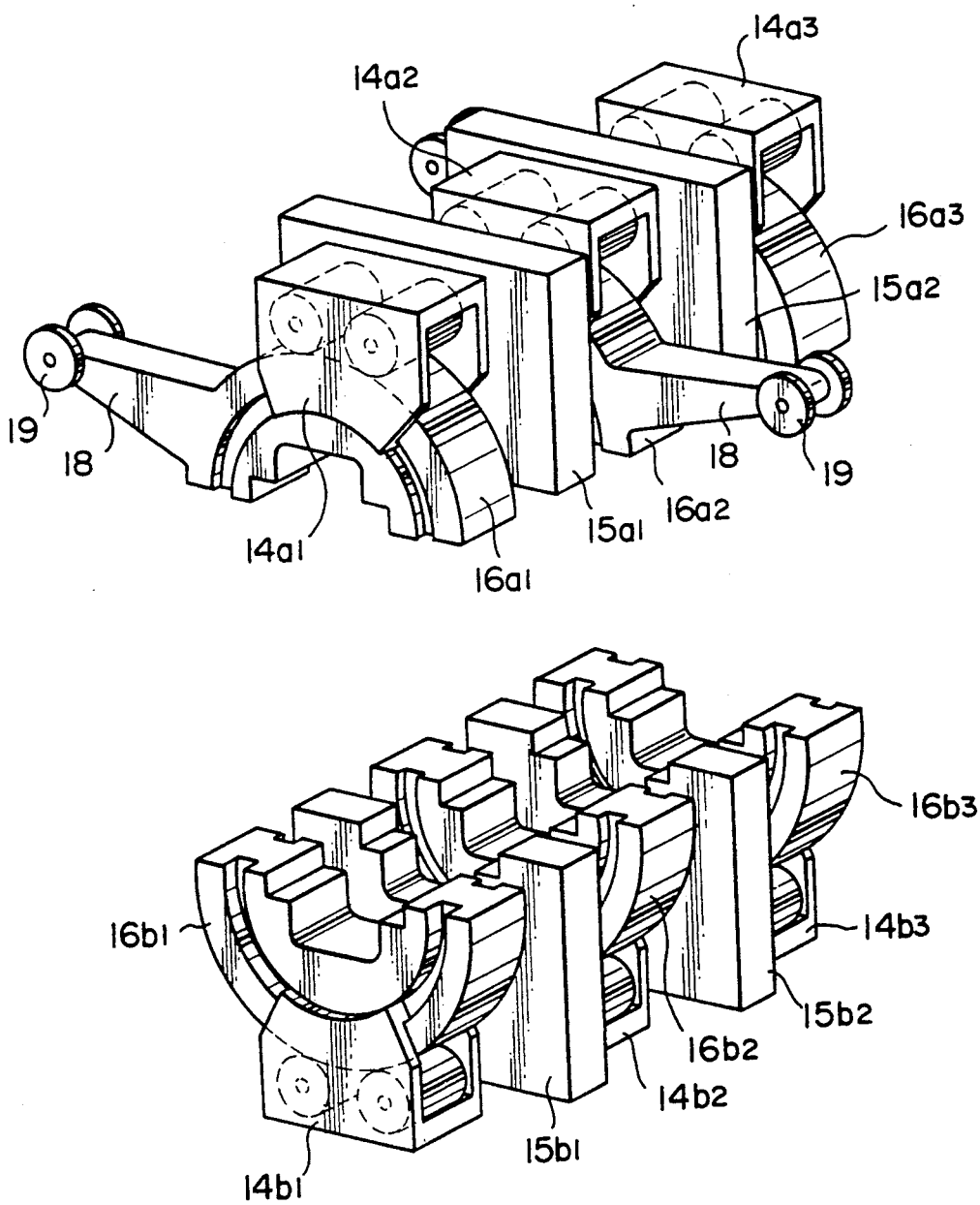
FIG. 6 is a perspective view of the retainer.

At this moment, since the flow rate of the oil from the cylinder 9 is controlled by the switch valve 87 an the relief valve 88, the slide 10 is lowered at a moderate speed according to the out flow rate of the oil from the cylinder 9. When the slide 10 is lowered to a predetermined position and the twist-forming dies 17*a* and 17*b* are closed as shown in FIG. 5, as clamping the workpiece W, the coining dies 25*a* and 25*b* are also closed as pressure-forming (coining) the workpiece W.

c) Twist-forming Operation

After the above-mentioned operations of cylinder pressurizing and die tightening, the switch valves 58 and 60 and the switch valve 87 are all deenergized and closed, whereby the main cylinders 7 and 8 are oil-locked, and the slide 10 is maintained in the before-mentioned held condition. When there is a fear that the pressure in the main cylinders 7 and 8 become insufficient during this process due to leakage of the pressurized oil, it may be permitted to provide a not-shown oil supplementing means for supplementing the required oil.

In this condition, when the solenoid a of the switch valve 65 arranged in the fourth tube passage 57 is excited, the pressurized oil from the hydraulic pump 51 is supplied through the throttleable check valve 66 and the tube passage 67 into the anti-rod side room of the twist-forming cylinder 22. The oil in the rod-side room is lowered through the tube passage 69 and the switch valve 65 into the tank 79 as being throttled by the throttleable check valve 68 with the flow rate controlled.

When the twisting force is allowed to be small in comparison to the pressurizing force and the die tightening force, the oil pressure applied to the twist-forming cylinder is allowed to be low. In this case, the switch valve 72 connected with the relief valve 70 of an outside pilot type is excited and opened, thereby activating the low pressure relief valve 73 and switching the discharge pressure of the hydraulic pump 51 into the lower pressure.

Through the above-mentioned operations, the rod of the twist-forming cylinder 22 is pushed down, and the twist ram 20 is lowered. The ram 20 holds the roller 19 mounted on the tip of the projecting arm 18 and rotates the upper retainer 16*a* together with the lower retainer 16*b* by a predetermined angle with these retainers supported by the upper retainer support member 14*a* and the lower retainer support member 14*b*, respectively. When the twist ram 18 abuts against the fixing stopper 40 or the movable stopper 26, the twist ram 20 stops moving. At this state, the twist-forming process for a workpiece W in the twist-forming section is completed.

d) Slide Raising Operation

After the twist-forming process, the pilot check valves 80 and 81 are opened by use of the pilot pressure from a not-shown pilot pressure source, and the solenoid a of the switch valve 65 is deenergized, thereby closing the valve 65. As a result, the main cylinders 7 and 8 are released to the oil tank 79 through the tube passages 82 and 83. The slide 10 is released from the pressing force of the main cylinders 7 and 8. The descending motion of the twist cylinder 22 is also stopped.

In this state, when the switch valve 62 is excited and opened, the pressurized oil from the hydraulic pump 51 flows through the tube passage 56 to the rod side room of the lifting cylinder 9. In this process, since the anti-rod side room of the lifting cylinder 9 is always opened to the tank 79, the oil in this room flows out towards the oil tank 79. As a result, the lifting cylinder is withdrawn and the slide 10 is raised.

c) Twist Return Operation

After the slide 10 is raised to a predetermined position, the switch valve 62 is deenergized and closed, and the solenoid b of the switch valve 65 is excited. As a result, the pressurized oil from the hydraulic pump 51 flows through the check valve 68 and the tube passage 69 into the rod side room of the twist-forming cylinder 22. The pressurized oil in the anti-rod side room of the cylinder 22 flows through the tube passage 67 and the throttleable check valve 66 into the oil tank 79 with the oil flow rate controlled by the check valve 66. As a result, the twist-forming cylinder 22 is withdrawn and the twist ram 20 is raised.

The twist ram 20 is provided with the twist return beam 21 at the lower portion thereof, and the roller 19 mounted on the tip portion of the projecting arm 18 is held between the twist ram 20 and the twist return beam 21. Therefore, when the twist ram 20 is raised, the upper retainer 16*a* is rotated to an original position through the roller 19 and the projecting arm 18 as supported by the upper retainer support means 14*a*.

During this process, the lower retainer 16*b* is also rotated to its original position by means of a lower retainer rotation return means (not shown). It is also possible to conduct the twist return process simultaneously with the raising process of the slide 10.

Although, in the above-mentioned operations, the twist-forming process and the coining process are carried out at the same time, each of these two processes can be individually carried out by providing an individual switch valve for the each process. In this case, the slide 10 suffers no offset load and can be smoothly operated for a long time, because the twist-forming section 13 and the coining section 23 are so arranged as to locate the twist-forming center P and the coining center Q on the axial center lines of the main cylinders 7 and 8, respectively.

Further, since the twist-forming section 13 and the coining section 23 are both located inside the same press, the two processes of twist-forming and coining can be carried out at the same time. The workpiece W at the twist-forming section 13 can be is easily transferred to the coining section 23 by use of a transfer feeder of the clamp type.

As described above, in the present invention, the twist-forming section 13 and the coining section 23 are both located inside of the same press, thereby facilating the twist-forming and the coining operations being carried out at the same time, whereby and the slide 10 suffers no offset load. Since the work w is transferred form the twist-forming position to the coining position in the same press, the work W can be transferred rapidly by means of the transfer feeder interconnected with the other motions of the press,

What is claimed is:

1. A twist-forming press for a crank shaft, comprising:

a press frame including a bed and first and second main cylinders each having a ram disposed in said press frame;

a slide connected with tip portions of each of the rams;

upper and lower twist-forming dies arranged between said slide and the bed of said press frame, said upper and lower twist-forming dies being operatively connected to said slide so as to clamp a workpiece in conjunction with sliding movement of said slide, said upper and lower twist-forming dies having opposed twist-forming surfaces with the opposed surfaces having a centerline;

means for rotating said upper and lower twist-forming dies to twist said workpiece clamped therebetween; and upper and lower coining dies arranged between said slide and the bed of said press frame, said upper and lower coining dies being operatively connected to said slide so as to pressingly close with each other in conjunction with the sliding movement of said slide, said upper and lower coining dies having opposed coining surfaces with the opposed surfaces having a centerline, said centerline of said upper and lower twist-forming dies being positioned to be in line with an axial centerline of the first main cylinder and said centerline of said upper and lower coining dies being positioned to be in line with an axial centerline of the second main cylinder.

2. A twist-forming press for a crank shaft claimed in claim 1, further comprising:

upper and lower retainers each holding said upper and lower dies, respectively; and upper and lower bolsters, said upper and lower retainers being rotatively mounted on said upper and lower bolsters, respectively, said lower bolster being fixedly mounted on the bed of said press frame, and provided with a movable stopper for controlling an amount of rotation of said upper and lower retainers and with a stopper height adjusting means for adjusting a height of the movable stopper.

3. A twist-forming press for a crank shaft claimed in claim 2, wherein said stopper height adjusting means is disposed below said movable stopper and has a length that extends from a front portion of said upper and lower twist-forming dies toward a rear portion thereof, said stopper height adjusting means including a wedge member wedgingly engaged with said movable stopper, a feeding screw device disposed in said lower bolster and engaged with the wedge member so as to move said wedge member forward and backward relative to said upper and lower twist-forming dies and a spring means for pressing said movable stopper against said wedge member.

4. A twist-forming press for a crank shaft claimed in claim 3, wherein said feeding screw device includes an indicator for indicating a transfer distance of said wedge member.

5. A twist-forming press for a crank shaft as claimed in claim 1, wherein said first and second cylinders are connected to a hydraulic pressure source through a first tube passage and a second tube passage, respectively, said first and second tube passages being provided therein with a first electromagnetic valve of a two port, two position-type and a second electromagnetic switch valve of a two port, two position-type, respectively.

6. A twist-forming and coining press system, comprising:

a press frame including a bed, and first and second main cylinders each having a ram;

a slide connected with tip portions of each of the rams so as to be slidingly connected in said press frame;

a twist-forming die assembly including upper and lower retainers rotatively mounted to said slide and the bed of said press frame, respectively, and upper and lower twist-forming dies each fixedly held in the upper and lower retainers, respectively, the upper retainer being operatively connected to said slide such that the upper and lower twist-forming dies clamp a workpiece in conjuction with sliding movement of said slide, said upper and lower twist-forming dies having opposed twist-forming surfaces with the opposed surfaces having a centerline;

means for rotating the upper and lower retainers to twist said workpiece clamped between said upper and lower twist-forming dies; and a coining die assembly including upper and lower coining dies positioned between said slide and the bed of said press frame, the upper and lower coining dies being operatively connected to said press frame so as to pressingly close with each other in conjunction with the sliding movement of said slide, said upper and lower coining dies having opposed coining surfaces with the opposed surfaces having a centerline, said centerline of said twist-forming die assembly being positioned to be in line with an axial centerline of the first main cylinder and said centerline of said coining die assembly being positioned to be in line with an axial centerline of the second main cylinder.

7. A twist-forming and coining press system as claimed in claim 6, further comprising:

upper and lower bolsters, the upper and lower retainers being rotatively mounted on said upper and lower bolsters, respectively, said upper bolster being fixedly mounted to said slide with said lower bolster being fixedly mounted on the bed of said press frame and provided with a movable stopper for controlling an amount of rotation of the upper and lower retainers and with a stopper height adjusting means for adjusting a height of the movable stopper.

8. A twist-forming and coining press system as claimed in claim 7, wherein the stopper height adjusting means is located below the movable stopper and has a length that extends from a front portion of said twist-forming die assembly toward a rear portion thereof, the stopper height adjusting means including a wedge member wedgingly engaged with the movable stopper, a feeding screw device disposed in said lower bolster and engaged with the wedge member so as to move the wedge member forward and backward relative to said twist-forming die assembly and a spring means for pressing the movable stopper against the wedge member.

9. A twist-forming and coining press system as claimed in claim 8, wherein the feeding screw device includes an indicator for indicating a transfer distance of the wedge member.

10. A twist-forming and coining press system as claimed in claim 7, wherein the stopper height adjusting means is located below the movable stopper and has a length that extends from a front portion of said twist-forming die assembly toward a rear portion thereof, the stopper height adjusting means including a wedge member wedgingly engaged with the movable stopper, a feeding screw device disposed in said lower bolster and engaged with the wedge member so as to move the wedge member forward and backward relative to said twist-forming die assembly and a spring means for pressing the movable stopper against the wedge member.

11. A twist-forming and coining press system as claimed in claim 10, wherein the feeding screw device includes an indicator for indicating a transfer distance of the wedge member.

* * * * *